US006712918B2

(12) United States Patent
Mendenhall et al.

(10) Patent No.: US 6,712,918 B2
(45) Date of Patent: Mar. 30, 2004

(54) BURN RATE ENHANCEMENT VIA A TRANSITION METAL COMPLEX OF DIAMMONIUM BITETRAZOLE

(75) Inventors: Ivan V. Mendenhall, Providence, UT (US); Michael W. Barnes, Brigham City, UT (US)

(73) Assignee: Autoliv ASP, Inc., Ogden, UT (US)

( * ) Notice: Subject to any disclaimer, the term of this patent is extended or adjusted under 35 U.S.C. 154(b) by 0 days.

(21) Appl. No.: 09/998,122

(22) Filed: Nov. 30, 2001

(65) Prior Publication Data

US 2003/0106624 A1 Jun. 12, 2003

(51) Int. Cl.[7] ..... C06B 47/08; C06B 31/00
(52) U.S. Cl. ..... 149/36; 149/45
(58) Field of Search ..... 149/36, 45

(56) References Cited

U.S. PATENT DOCUMENTS

| | | | | |
|---|---|---|---|---|
| 4,798,637 A | | 1/1989 | Hendrickson | |
| 5,516,377 A | | 5/1996 | Highsmith et al. | |
| 5,629,494 A | | 5/1997 | Barnes et al. | |
| 5,962,808 A | | 10/1999 | Lundstrom | |
| 6,077,371 A | | 6/2000 | Lundstrom et al. | |
| 6,433,181 B1 | * | 8/2002 | Hyoda et al. | 548/250 |

FOREIGN PATENT DOCUMENTS

| | | | | |
|---|---|---|---|---|
| EP | 1 195 367 | | 4/2002 | |
| JP | 191649 | * | 7/2000 | C07D/257/04 |
| WO | 98/22208 | | 5/1998 | |
| WO | 01/23304 | | 9/2000 | |

* cited by examiner

*Primary Examiner*—Michael J. Carone
*Assistant Examiner*—Aileen B. Felton
(74) *Attorney, Agent, or Firm*—James D. Erickson; Sally J. Brown

(57) ABSTRACT

A method for increasing the burn rate of a gas generant formulation is provided involving the addition of a quantity of at least one transition metal complex of diammonium bitetrazole to the gas generant formulation.

25 Claims, 3 Drawing Sheets

BURN RATE ENHANCEMENT VIA A TRANSITION METAL COMPLEX OF DIAMMONIUM BITETRAZOLE

BACKGROUND OF THE INVENTION

This invention relates generally to gas generant materials such as used to inflate automotive inflatable restraint airbag cushions and, more particularly, to the enhancement of the rate at which such materials burn or otherwise react.

Gas generating materials are useful in a variety of different contexts. One significant use for such compositions is in the operation of automotive inflatable restraint airbag cushions. It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Such systems typically also include one or more crash sensors mounted on or to the frame or body of the vehicle to detect sudden decelerations of the vehicle and to electronically trigger activation of the system. Upon actuation of the system, the cushion begins to be inflated in a matter of no more than a few milliseconds with gas produced or supplied by a device commonly referred to as an "inflator." In practice, such an airbag cushion is desirably deployed into a location within the vehicle between the occupant and certain parts of the vehicle interior, such as a door, steering wheel, instrument panel or the like, to prevent or avoid the occupant from forcibly striking such part(s) of the vehicle interior.

Gas generant compositions commonly utilized in the inflation of automotive inflatable restraint airbag cushions have previously most typically employed or been based on sodium azide. Such sodium azide-based compositions, upon initiation, normally produce or form nitrogen gas. While the use of sodium azide and certain other azide-based gas generant materials meets current industry specifications, guidelines and standards, such use may involve or raise potential concerns such as relating to the safe and effective handling, supply and disposal of such gas generant materials.

In view thereof, significant efforts have been directed to minimizing or avoiding the use of sodium azide in automotive airbag inflators. Through such efforts, various combinations of non-azide fuels and oxidizers have been proposed for use in gas generant compositions. These non-azide fuels are generally desirably less toxic to make and use, as compared to sodium azide, and may therefore be easier to dispose of and thus, at least in part, found more acceptable by the general public. Further, non-azide fuels composed of carbon, hydrogen, nitrogen and oxygen atoms typically yield all gaseous products upon combustion. As will be appreciated by those skilled in the art, fuels with high nitrogen and hydrogen contents and a low carbon content are generally attractive for use in such inflatable restraint applications due to their relatively high gas outputs (such as measured in terms of moles of gas produced per 100 grams of gas generant material).

Most oxidizers known in the art and commonly employed in such gas generant compositions are metal salts of oxygen-bearing anions (such as nitrates, chlorates and perchlorates, for example) or metal oxides. Unfortunately, upon combustion, the metallic components of such oxidizers typically end up as a solid and thus reduce the relative gas yield realizable therefrom. Consequently, the amount of such oxidizers in a particular formulation typically affects the gas output or yield from the formulation. If oxygen is incorporated into the fuel material, however, less of such an oxidizer may be required and the gas output of the formulation can be increased.

In addition to low toxicity and high gas outputs, gas generant materials desirably are relatively inexpensive, thermally stable (i.e., desirably decompose only at temperatures greater than about 160° C.), and have a low affinity for moisture.

In addition to the above-identified desirable properties and characteristics, gas generant materials for use in automotive inflatable restraint applications must be sufficiently reactive such that upon the proper initiation of the reaction thereof, the resulting gas producing or generating reaction occurs sufficiently rapidly such that a corresponding inflatable airbag cushion is properly inflated so as to provide desired impact protection to an associated vehicle occupant. In general, the burn rate for a gas generant composition can be represented by the equation (1), below:

$$r_b=k(P)^n \quad (1)$$

where, $r_b$=burn rate (linear)

k=constant

P=pressure n=pressure exponent, where the pressure exponent is the slope of a linear regression line drawn through a log—log plot of burn rate versus pressure.

Guanidine nitrate ($CH_6N_4O_3$) is a non-azide fuel with many of the above-identified desirable fuel properties and which has been widely utilized in the automotive airbag industry. For example, guanidine nitrate is commercially available, relatively low cost, non-toxic, provides excellent gas output due to a high content of nitrogen, hydrogen and oxygen and a low carbon content and has sufficient thermal stability to permit spray dry processing.

Unfortunately, guanidine nitrate suffers from a lower than may be desired burn rate. Thus, there remains a need and a demand for an azide-free gas generant material which may more effectively overcome one or more of the problems or shortcomings described above.

Commonly assigned U.S. patent application Ser. No. 09/715,459, filed Nov. 17, 2000, relates generally to gas generant compositions which desirably include or contain guanylurea nitrate (also known as dicyandiamidine and amidinourea). In particular, guanylurea nitrate advantageously has a relatively high theoretical density such as to permit a relatively high loading density for a gas generant material which contains such a fuel component. Further, guanylurea nitrate exhibits excellent thermal stability, as evidenced by guanylurea nitrate having a thermal decomposition temperature of 216° C. In addition, guanylurea nitrate has a large negative heat of formation (i.e., −880 cal/gram) such as results in a cooler burning gas generant composition, as compared to an otherwise similar gas generant containing guanidine nitrate.

While the inclusion or use of guanylurea nitrate in gas generant materials can serve to avoid reliance on the inclusion or use of sodium azide or other similar azide materials while providing improved burn rates and overcoming one or more of the problems, shortcomings or limitations such as relating to cost, commercial availability, low toxicity, thermally stability and low affinity for moisture, even further improvement in the burn rate of gas generant formulations may be desired or required for particular applications.

For some inflator applications, a low gas generant formulation burn rate can be at least partially compensated for by reducing the size of the shape or form of the gas generant material such as to provide the gas generant material in a shape or form having a relatively larger reactive surface area. In practice, however, there are practical limits to the minimum size of the shape or form, such as a tablet, for example, to which gas generant materials can reproducibly be manufactured and increased burn rates may be needed for particular applications which require a higher inflator performance.

Thus, there is a need and a demand for methods or techniques for increasing the burn rate of a gas generant formulation as well as for non-azide based gas generant formulations having desirably increased or elevated burn rates.

SUMMARY OF THE INVENTION

A general object of the invention is to provide a method for increasing the burn rate of a gas generant formulation as well as an improved gas generant formulation.

A more specific objective of the invention is to overcome one or more of the problems described above.

The general object of the invention can be attained, at least in part, through a method which involves adding a quantity of at least one transition metal complex of diammonium bitetrazole to the gas generant formulation. In specific preferred embodiments, the at least one transition metal complex of diammonium bitetrazole is present in the gas generant formulation in a relative amount of at least 5 wt. % and at least 10 wt. %, respectively.

The prior art generally fails to provide as effective as may be desired methods or techniques for the raising of the burn rate of a gas generant formulation, particularly a non-azide gas generant formulation, to a level sufficient and desired for vehicular inflatable restraint system applications and in a manner practical and appropriate for such applications. Further, the prior art also generally fails to provide corresponding or associated non-azide gas generant formulations which exhibit sufficiently and effectively elevated burn rates as may be desired for such vehicular inflatable restraint system applications.

In accordance with one preferred embodiment of the invention there is comprehended a method for increasing the burn rate of a gas generant formulation and which method involves including a quantity of at least about 5 composition weight percent of a copper complex of diammonium bitetrazole having an empirical formula of $CuC_2H_6N_{10}$ in the gas generant formulation.

The invention still further comprehends, in accordance with another preferred embodiment of the invention, a gas generant formulation which includes:

- a primary fuel component selected from the group consisting of copper bis-guanyl urea dinitrate, guanidine nitrate and mixtures thereof;
- a primary oxidizer component selected from the group consisting of ammonium nitrate, basic copper nitrate, copper diammine dinitrate and mixtures of ammonium nitrate and copper diammine dinitrate; and
- at least one transition metal complex of diammonium bitetrazole effective to enhance the burn rate of the gas generant formulation as compared to the same gas generant formulation without inclusion of the at least one transition metal complex of diammonium bitetrazole.

As used herein, references to a specific composition, component or material as a "fuel" are to be understood to refer to a chemical which generally lacks sufficient oxygen to burn completely to $CO_2$, $H_2O$ and $N_2$.

Correspondingly, references herein to a specific composition, component or material as an "oxidizer" are to be understood to refer to a chemical generally having more than sufficient oxygen to burn completely to $CO_2$, $H_2O$ and $N_2$.

Guanylurea nitrate ($NH_2C(NH)NHC(O)NH_2.HNO_3$) is also commonly known as dicyandiamidine and amidinourea.

Other objects and advantages will be apparent to those skilled in the art from the following detailed description taken in conjunction with the appended claims and drawings.

DETAILED DESCRIPTION OF THE INVENTION

Figure 1:
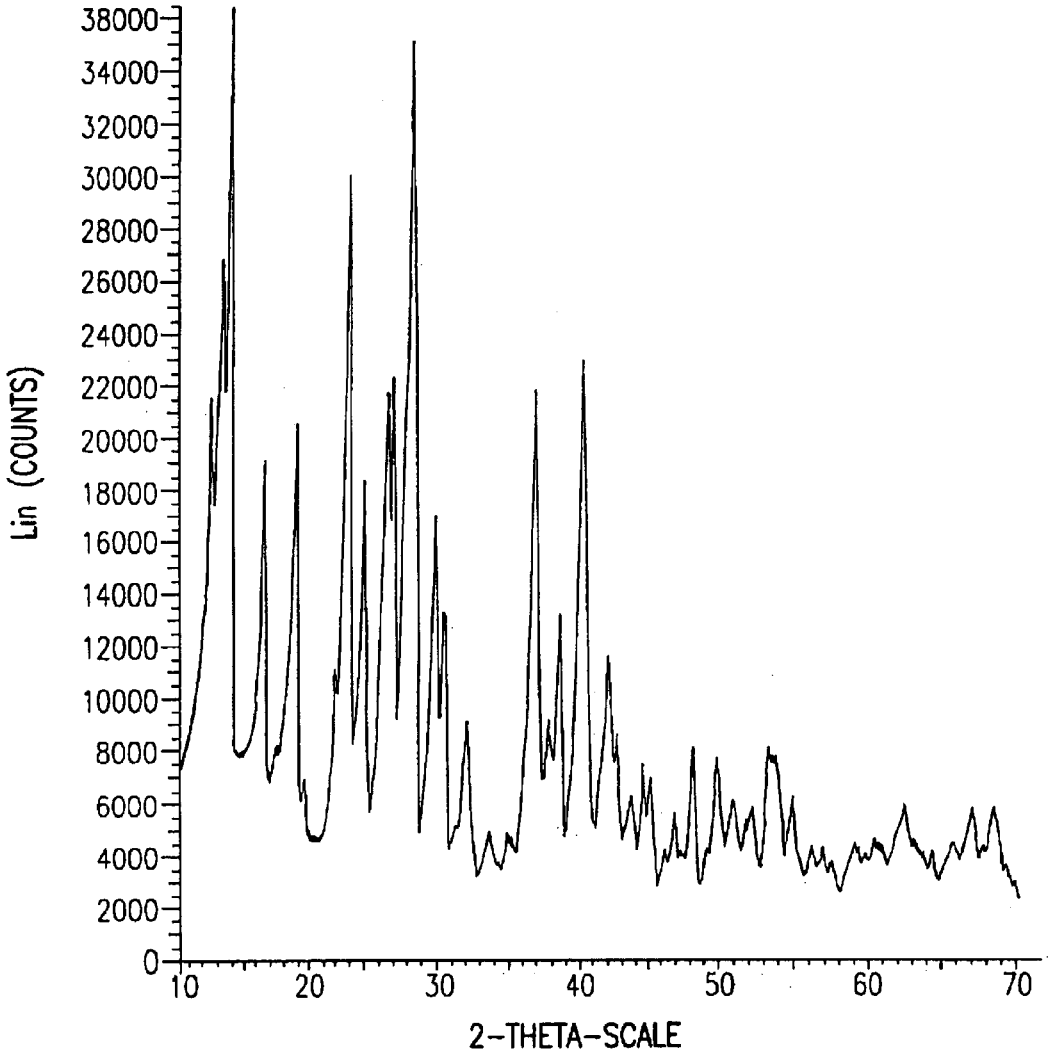
FIG. 1 a graphical representation of the x-ray diffraction pattern (in counts versus 2-Theta angle) obtained with the copper complex of diammonium bitetrazole of Example 1.

The present invention provides a method for increasing the burn rate of a gas generant formulation as well as an improved gas generant formulation. As described in greater detail below and in accordance with one preferred embodiment of the invention, such method desirably involves the addition of a quantity of at least one transition metal complex of diammonium bitetrazole to the gas generant formulation.

Suitable transition metals for use in the practice of the invention include copper, zinc, cobalt, iron, nickel and chromium. Preferred transition metals used in the practice of the invention include zinc and copper. A particularly preferred transition metal complex of diammonium bitetrazole for use in the practice of the invention is a copper complex of diammonium bitetrazole having an empirical formula of $CuC_2H_6N_{10}$.

Those skilled in the art and guided by the teachings herein provided will appreciate that the invention can desirably be practice via the inclusion of a sufficient quantity of at least one transition metal complex of diammonium bitetrazole to the gas generant formulation to effect a desirable increase in the burn rate exhibited by the resulting formulation, as compared to the same formulation without the inclusion of such transition metal complex of diammonium bitetrazole. In general, however, it has been found preferable for a gas generant formulation in accordance with a preferred practice of the invention to include or incorporate the at least one transition metal complex of diammonium bitetrazole in a relative amount of at least 5 wt. % and, more preferably, in a relative amount of at least 10 wt. % in order to provide gas generant formulations evidencing a sufficiently increased burn rate effective for such inflatable restraint system applications.

While the broader practice of the invention is not necessarily limited to the incorporation or use of such a transition metal complex of diammonium bitetrazole in combination or conjunction with particular or specific gas generant formulations, the invention is believed to have particular benefit or utility in gas generant formulations that contain or include either or both guanidine nitrate and copper bis-guanyl urea dinitrate as a primary fuel and a primary oxidizer selected from the group consisting of ammonium nitrate, basic copper nitrate, copper diammine dinitrate and mixtures of ammonium nitrate and copper diammine dinitrate. For example, one preferred gas generant formulation for the incorporation or use of such a transition metal complex of diammonium bitetrazole in accordance with the invention includes ammonium nitrate as a primary oxidizer and copper bis-guanyl urea dinitrate as a primary fuel. Another preferred gas generant formulation for the incorporation or use of such a transition metal complex of diammonium bitetrazole in accordance with the invention includes basic copper nitrate as a primary oxidizer and guanidine nitrate as a primary fuel.

Those skilled in the art and guided by the teachings will further appreciate that various procedures or reaction schemes can be employed in the preparation of a transition metal complex of diammonium bitetrazole in accordance with the invention. For example, in accordance with one preferred practice of such reaction scheme, a spray-dry mix tank is charged with water. A selected quantity of diammonium 5,5'-bitetrazole is added to the spray-dry mix tank and partially dissolved in or with the water. Cupric oxide is then added and the temperature of the slurry equilibrated at 190° F. and held at that temperature until the reaction is complete (approximately 1 hour). Other desired gas generant ingredients (e.g., fuel, oxidizer, slagging aids, etc.) are then added to the reaction mixture slurry. The reaction mixture slurry can then be pumped to a nozzle and spray dried. Further processing steps such as blending, pressing, igniter coating, etc. or the like can then be performed per standard procedures.

TABLE 1, below, lists certain select properties of the copper complex of diammonium 5,5'-bitetrazole in accordance with the invention.

TABLE 1

| PROPERTY | VALUE |
|---|---|
| Thermal onset of decomposition | 250° C. |
| Color | blue/purple powder |
| Water solubility | sparingly |
| Content | (mass percent) |
| copper | 27.28 |
| carbon | 10.32 |
| hydrogen | 2.44 |
| nitrogen | 57.55 |

As further detailed herein, particular reaction schemes which can be used in the preparation of the copper complex of diammonium bitetrazole having an empirical formula of $CuC_2H_6N_{10}$, described above, are shown in reactions 2–5, below:

$$CuO+C_2H_8N_{10}(\text{diammonium 5,5'-bitetrazole})\rightarrow CuC_2H_6N_{10}+H_2O \quad (2)$$

$$Cu(OH)_2CuCO_3+2C_2H_8N_{10}\rightarrow 2CuC_2H_6N_{10}+3H_2O+CO_2 \quad (3)$$

$$Cu(NH_3)_2CO_3+C_2H_2N_8(\text{bitetrazole})\rightarrow CuC_2H_6N_{10}+H_2O+CO_2 \quad (4)$$

$$Cu(OH)_2+C_2H_8N_{10}\rightarrow CuC_2H_6N_{10}+2H_2O \quad (5)$$

As detailed below, the reaction scheme shown in reaction (2) has been currently found to be preferred.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1

Preparation of Copper Diammonium Bitetrazole Via Reaction (2), Above

In this Example, 68.38 grams of diammonium bitetrazole were suspended in 100 ml of water. Subsequently, 31.62 grams of cupric oxide were added to the reaction mixture. The resulting reaction mixture was stirred and heated to 90° C. for approximately 1 hour. A powder blue solid was formed in a yield of 90.50 grams as compared to a theoretical yield of 92.84 grams. TABLE 2, below, identifies the elemental chemical analysis of the material formed as well as the elemental chemical analysis for a corresponding theoretical composition of $CuC_2H_6N_{10}$. The x-ray diffraction pattern obtained for a powder sample of the material of Example 1 is shown in FIG. 1.

Example 2

Preparation of Copper Diammonium Bitetrazole Via Reaction (3), Above

Figure 2:
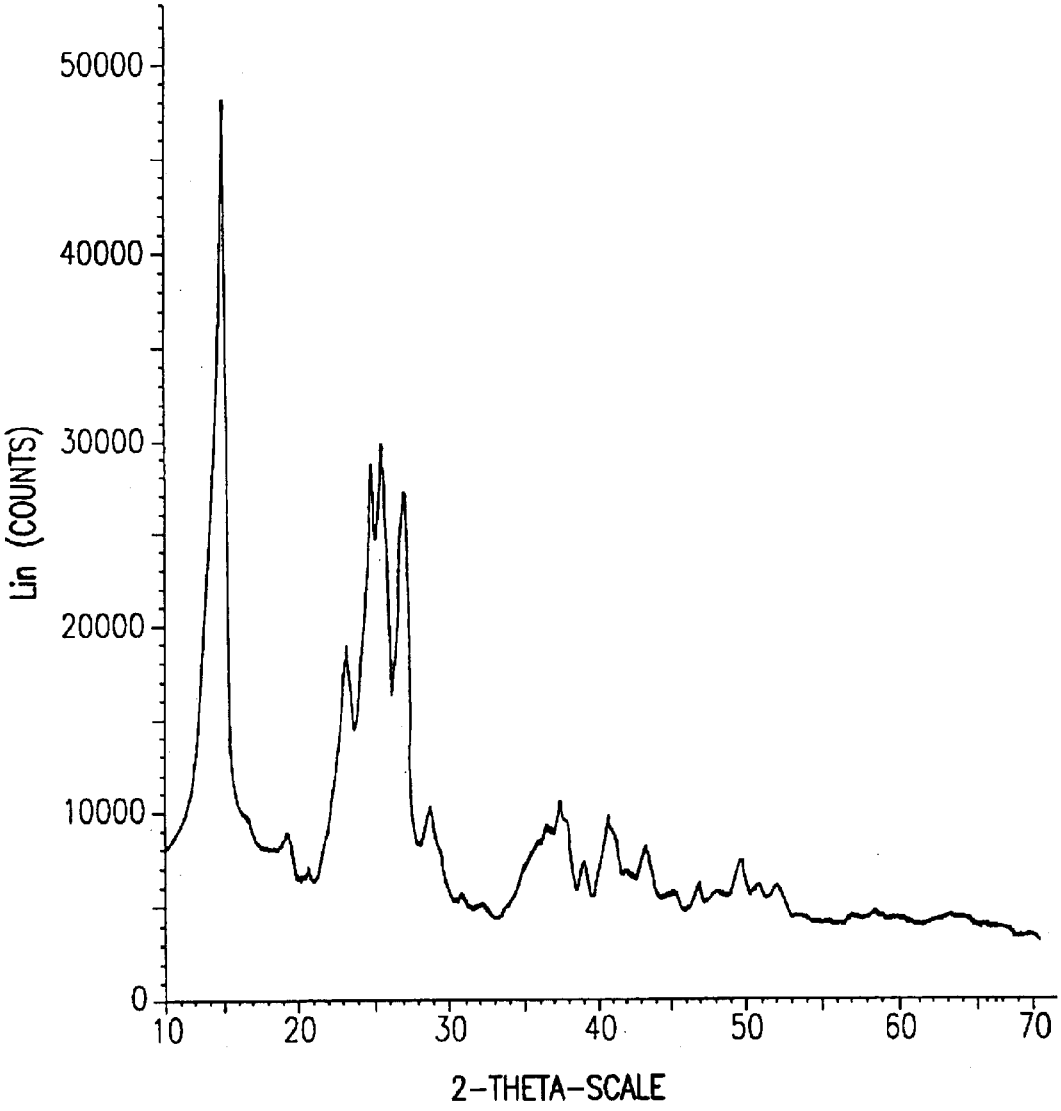
FIG. 2 a graphical representation of the x-ray diffraction pattern (in counts versus 2-Theta angle) obtained with the copper complex of diammonium bitetrazole of Example 2.

In this Example, 60.87 grams of diammonium bitetrazole were suspended in 120 ml of deionized water. Subsequently, 39.13 grams of basic copper carbonate were added to the reaction mixture. The resulting reaction mixture was heated to 90° C. and continued to be heated and stirred for approximately 1 hour. A solid was formed that was filtered, washed with water, filtered again and then vacuum oven dried at 80° C. The resulting solid was in a yield of 85.95 grams as compared to the theoretical yield of 83.86 grams. (NOTE: The greater than theoretical yield is believed attributable to incomplete conversion of the starting materials during processing.) TABLE 2, below, identifies the elemental chemical analysis of the material formed as well as the elemental chemical analysis for a corresponding theoretical composition of $CuC_2H_6N_{10}$. The x-ray diffraction pattern obtained for a powder sample of the material of Example 2 is shown in FIG. 2.

Example 3

Preparation of Copper Diammonium Bitetrazole Via Reaction (4), Above

Figure 3:
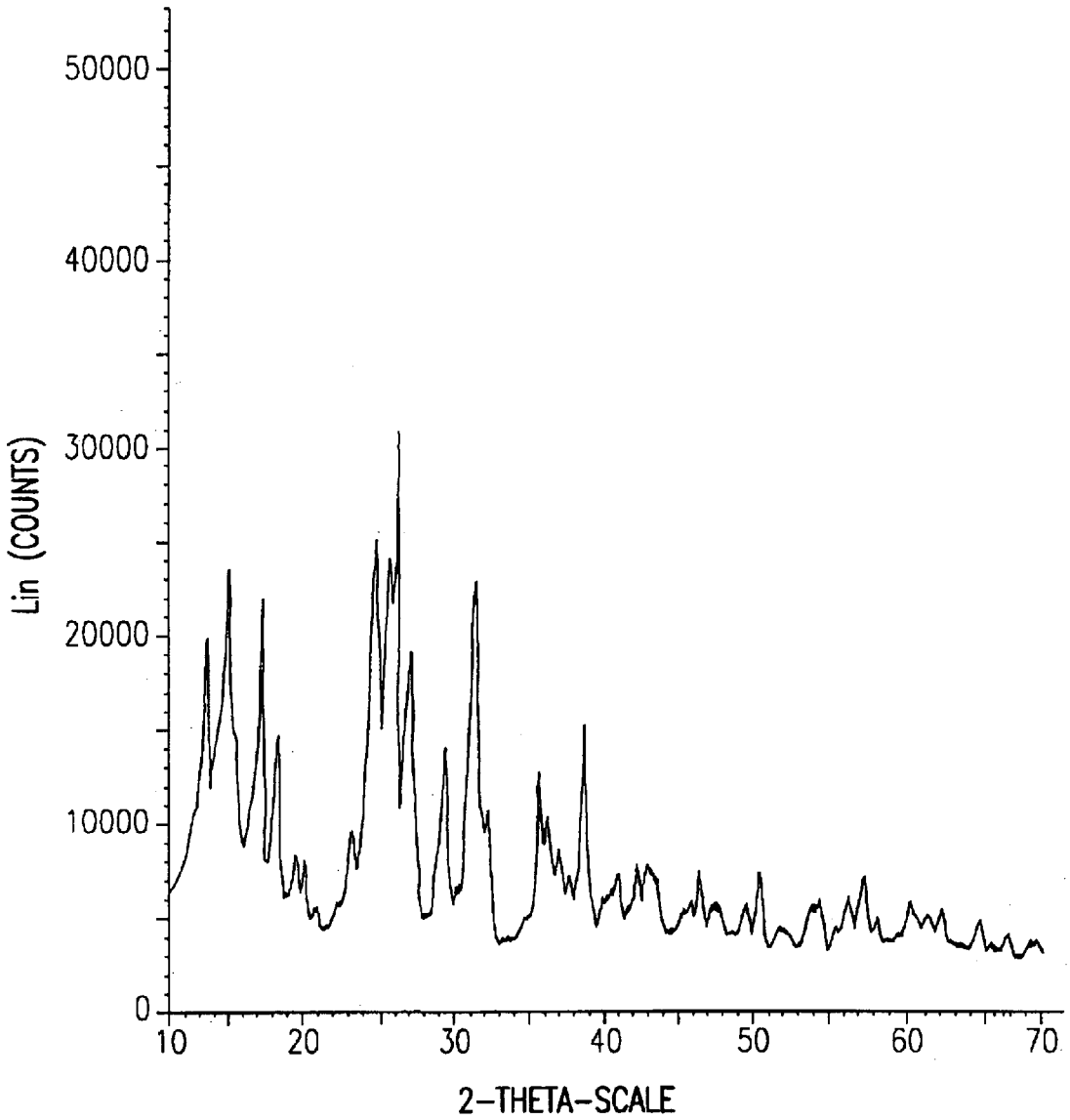
FIG. 3 a graphical representation of the x-ray diffraction pattern (in counts versus 2-Theta angle) obtained with the copper complex of diammonium bitetrazole of Example 3.

In this Example, 49.88 grams of bitetrazole were suspended in 100 ml of water. Subsequently, 53.31 grams of copper diammonium carbonate were slowly added to the reaction mixture and the reaction mixture was allowed to off-gas. The resulting reaction mixture was then heated to 90° C. and held at that temperature for approximately 1 hour. A solid was formed that was filtered, washed with water, filtered again and then vacuum oven dried at 80° C. The resulting solid was in a yield of 80.45 grams as compared to the theoretical yield of 79.69 grams. (NOTE: The greater than theoretical yield is believed again attributable to incomplete conversion of the starting materials during processing.) TABLE 2, below, identifies the elemental chemical analysis of the material formed as well as the elemental chemical analysis for a corresponding theoretical composition of $CuC_2H_6N_{10}$. The x-ray diffraction pattern obtained for a powder sample of the material of Example 3 is shown in FIG. 3.

TABLE 2

| | Elemental Chemical Analysis (mass %) | | | |
|---|---|---|---|---|
| | EXAMPLE 1 | EXAMPLE 2 | EXAMPLE 3 | Theoretical |
| Cu | 27.57 | 25.21 | 26.68 | 27.21 |
| C | 10.22 | 10.69 | 10.44 | 10.28 |
| H | 2.73 | 2.89 | 2.54 | 2.57 |
| N | 57.50 | 52.63 | 58.45 | 59.95 |

Discussion of Results

One method or technique commonly employed to verify what was made during a chemical synthesis is to compare a chemical analysis of the sample product on an elemental basis with the theoretical values. As shown in TABLE 2, Example 1 exhibited very close agreement between the chemical analysis of the sample product and the theoretical values therefor. Example 3 also exhibited pretty good agreement between the chemical analysis of the sample product and the theoretical values therefor. Example 2, however, appears to have exhibited the most significant departure between the chemical analysis of the sample product and the theoretical values therefor. This departure is believed to be at least in part attributable to incomplete conversion of the starting materials during processing. In this regard, it is noted that the greater than theoretical yield experienced in Example 2 and, to a lesser degree in Example 3, are also consistent with the incomplete conversion of the starting materials during processing.

The x-ray diffraction patterns shown in FIGS. 1–3 for Examples 1–3 show that eventhough the material/compound of each of Examples 1–3 was elementally similar, the material/compound formed in each case was somewhat different.

Examples 4–6 and Comparative Example 1

In these tests, 100 grams of each of the gas generant formulations having the compositions identified in TABLE 3 below were prepared using the following procedure:

Guanidine nitrate (GN) was predissolved in 50 ml of water and heated to 90° C. Subsequently, a dry blend of the remaining formulation solids were stirred in, mixed well and then vacuum oven dried at 80° C.

Note that, Example 4 utilized the copper diammonium bitetrazole made in Example 1, Example 5 utilized the copper diammonium bitetrazole made in Example 2 and Example 6 utilized the copper diammonium bitetrazole made in Example 3.

TABLE 3

| | EXAMPLES 4–6 | COMPARATIVE EXAMPLE 1 |
|---|---|---|
| BCN | 50.28 | 45.26 |
| GN | 36.72 | 51.74 |
| $CuC_2H_6N_{10}$ | 10.00 | -0- |
| $Al_2O_3$ | 3.00 | 3.00 |

where,
BCN = basic copper nitrate and
GN = guanidine nitrate.

The gas generant formulation of each of Examples 4–6 and Comparative Example 1 was then tested. The burn rate and density (ρ) values identified in TABLE 4 below were obtained. In particular, the burn rate data was obtained by first pressing samples of the respective gas generant formulations into the shape or form of a 0.5 inch diameter cylinder using a hydraulic press (12,000 lbs force). Typically enough powder was used to result in a cylinder length of 0.5 inch. The cylinders were then each coated on all surfaces except the top one with a kyrlon ignition inhibitor to help ensure a linear burn in the test fixture. In each case, the so coated cylinder was placed in a 1-liter closed vessel or bomb capable of being pressurized to several thousand psi with nitrogen and equipped with a pressure transducer for accurate measurement of bomb pressure. A small sample of igniter powder was placed on top of the cylinder and a nichrome wire was passed through the igniter powder and connected to electrodes mounted in the bomb lid. The bomb was then pressurized to the desired pressure and the sample ignited by passing a current through the nichrome wire. Pressure vs. time data was collected as each of the respective samples were burned. Since combustion of each of the samples generated gas, an increase in bomb pressure signaled the start of combustion and a "leveling off" of pressure signaled the end of combustion. The time required for combustion was equal to $t_2-t_1$ where $t_2$ is the time at the end of combustion and $t_1$ is the time at the start of combustion. The sample weight was divided by combustion time to give a burning rate in grams per second. Burning rates were typically measured at four pressures (900, 1350, 2000, and 3000 psi). The log of burn rate vs the log of average pressure was then plotted. From this line the burn rate at any pressure can be calculated using the gas generant composition burn rate equation (1), identified above.

TABLE 4

| | EXAMPLE 4 | EXAMPLE 5 | EXAMPLE 6 | COMPARATIVE EXAMPLE 1 |
|---|---|---|---|---|
| $r_b$ | 0.52 | 0.42 | 0.47 | 0.36 |
| n | 0.37 | 0.43 | 0.38 | 0.37 |
| k | 0.042 | 0.021 | 0.034 | 0.028 |
| ρ (g/cc) | 2.10 | 2.10 | 2.10 | 1.91 |

where,
$r_b$ = burn rate at 1000 psi in inch per second (ips);
n = pressure exponent in the burn rate equation (1) identified above, where the pressure exponent is the slope of the plot of the log of pressure along the x-axis versus the log of the burn rate along the y-axis; and
k = the constant in the burn rate equation (1) identified above.

Discussion of Results

As shown in TABLE 4, the gas generant formulation of each of Examples 4–6, which gas generant formulations each contained the copper complex of diammonium bitetrazole, in accordance with a preferred practice of the invention, all experienced increased burn rates ($r_b$) as compared to the gas generant formulation of Comparative Example 1.

Further, as the pressure exponent (n) generally corresponds to the performance sensitivity the respective gas generant material, with lower burn rate pressure exponents corresponding to gas generant materials which desirably exhibit corresponding lesser or reduced pressure sensitivity, these examples show that the inclusion of the copper complex of diammonium bitetrazole, in accordance with a preferred practice of the invention, can desirably increase the burn rate of the gas generant formulation without significantly increasing the pressure sensitivity of the resulting formulation.

As also shown in TABLE 4, the gas generant formulations of each of Examples 4–6 and in accordance with the invention had a density which was significantly greater than the gas generant formulation of Comparative Example 1. Those skilled in the art and guided by the teachings herein provided will appreciate that gas generant formulations of increased density can desirably be used such as to increase the volume of gas produced on a unit volume basis and thereby at least partially offset any decrease in the moles of gas produced on a mass basis associated with replacement of some of the guanidine nitrate with the complex material, in accordance with the invention.

Example 7 and Comparative Example 2

In these tests, 100 gram batches of the gas generant formulations identified in TABLE 5 below were prepared. Note the formulations were otherwise similar except for the inclusion of the copper complex of diammine 5,5'-bitetrazole in Example 7. The formulations each contained ammonium nitrate as the primary oxidizer, copper bis-guanyl urea dinitrate as the primary fuel, copper diammine dinitrate and potassium nitrate as additives, e.g., as phase stabilizers, and silicon dioxide also as an additive, e.g., slagging agent.

TABLE 5

| | EXAMPLE 7 | COMPARATIVE EXAMPLE 2 |
|---|---|---|
| Ammonium nitrate | 59.34 | 55.81 |
| Copper bis-guanyl urea dinitrate | 22.47 | 36.00 |
| Silicon dioxide | 3.00 | 3.00 |
| Copper diammine dinitrate | 2.75 | 2.75 |
| Potassium nitrate | 2.44 | 2.44 |
| Copper diammine 5,5'-bitetrazole | 10.00 | -0- |

The gas generant formulation of each of Example 7 and Comparative Example 2 was then tested. The burn rate and density (ρ) values identified in TABLE 6 below were obtained. The burn rate data was obtained in the same general manner described above relative to Examples 4–6 and Comparative Example 1 with the samples being pressed into a cylinder shape or form, coated, placed in a closed vessel or bomb with a small sample of igniter powder placed on top of the cylinder and a nichrome wire was passed through the igniter powder and connected to electrodes mounted in the bomb lid. The bomb was then pressurized to the desired pressure and the sample ignited by passing a current through the nichrome wire. Pressure vs. time data was collected as each of the respective samples were burned. Since combustion of each of the samples generated gas, an increase in bomb pressure signaled the start of combustion and a "leveling off" of pressure signaled the end of combustion. The time required for combustion was equal to $t_2-t_1$ where $t_2$ is the time at the end of combustion and $t_1$ is the time at the start of combustion. The sample weight was divided by combustion time to give a burning rate in grams per second. Burning rates were typically measured at four pressures (900, 1350, 2000, and 3000 psi). The log of burn rate vs the log of average pressure was then plotted. From this line the burn rate at any pressure can be calculated using the gas generant composition burn rate equation (1), identified above.

TABLE 6

| | EXAMPLE 7 | COMPARATIVE EXAMPLE 2 |
|---|---|---|
| $r_b$ | 0.34 | 0.28 |
| n | 0.67 | 0.76 |
| k | 0.003 | 0.002 |
| ρ (g/cc) | 1.85 | 1.84 |

where,
$r_b$ = burn rate at 1000 psi in inch per second (ips);
n = pressure exponent in the burn rate equation (1) identified above, where the pressure exponent is the slope of the plot of the log of pressure along the x-axis versus the log of the burn rate along the y-axis; and
k = the constant in the burn rate equation (1) identified above.

Discussion of Results

As shown in TABLE 6, the gas generant formulation of Example 7, which gas generant formulation contained the copper complex of diammonium bitetrazole, in accordance with a preferred practice of the invention, experienced a significantly increased burn rate ($r_b$) as compared to the gas generant formulation of Comparative Example 2.

Further, the gas generant formulation of Example 7 exhibited a lesser or reduced pressure sensitivity as compared to the gas generant formulation of Comparative Example 2, as evidenced by the lower or decreased pressure exponent (n) obtained therewith.

Thus, the invention provides an effective method or technique for desirably raising or increasing of the burn rate of a gas generant formulation, particularly a non-azide gas generant formulation, to a level sufficient and desired for vehicular inflatable restraint system applications and in a manner practical and appropriate for such applications. Further, the invention also provides corresponding or associated non-azide gas generant formulations which exhibit sufficiently and effectively elevated burn rates as may be desired for such vehicular inflatable restraint system applications.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method for increasing the burn rate of a gas generant formulation, the method comprising:

adding a quantity of at least one transition metal complex of diammonium bitetrazole to the gas generant formulation, wherein, after the addition, the at least one transition metal complex of diammonium bitetrazole is present in the gas generant formulation in a relative amount of at least 5 wt. %.

2. The method of claim 1 wherein after the addition, the at least one transition metal complex of diammonium bitetrazole is present in the gas generant formulation in a relative amount of at least 10 wt. %.

3. The method of claim 1 wherein the at least one transition metal complex of diammonium bitetrazole comprises a transition metal selected from the group consisting of copper, zinc, cobalt, iron, nickel and chromium.

4. A method for increasing the burn rate of a gas generant formulation, the method comprising:

adding a quantity of at least one transition metal complex of diammonium bitetrazole to the gas generant formulation, wherein the at least one transition metal complex of diammonium bitetrazole comprises the transition metal copper.

5. The method of claim 4 wherein after the addition, the copper complex of diammonium bitetrazole is present in the gas generant formulation in a relative amount of at least 5 wt. %.

6. The method of claim 4 wherein after the addition, the copper complex of diammonium bitetrazole is present in the gas generant formulation in a relative amount of at least 10 wt. %.

7. The method of claim 4 wherein the copper complex of diammonium bitetrazole has an empirical formula of $CuC_2H_6N_{10}$.

8. The method of claim 4 wherein the copper complex of diammonium bitetrazole is formed by reacting CuO with diammonium 5,5'-bitetrazole.

9. The method of claim 1 wherein the gas generant formulation contains copper bis-guanyl urea dinitrate as a primary fuel.

10. The method of claim 9 wherein the gas generant formulation contains ammonium nitrate as a primary oxidizer.

11. The method of claim of claim 1 wherein the gas generant formulation contains guanidine nitrate as a primary fuel.

12. The method of claim of claim 11 wherein the gas generant formulation contains basic copper nitrate as a primary oxidizer.

13. The method of claim of claim 1 wherein the gas generant formulation contains a primary oxidizer selected from the group consisting of ammonium nitrate, basic copper nitrate, copper diammine dinitrate and mixtures of ammonium nitrate and copper diammine dinitrate.

14. A method for increasing the burn rate of a gas generant formulation, the method comprising:

including a quantity of at least about 5 composition weight percent of a copper complex of diammonium bitetrazole having an empirical formula of $CuC_2H_6N_{10}$ in the gas generant formulation.

15. The method of claim 14 wherein the copper complex of diammonium bitetrazole is included in the gas generant formulation in a quantity of at least about 10 composition weight percent.

16. The method of claim 14 wherein the copper complex of diammonium bitetrazole is formed by reacting CuO with diammonium 5,5'-bitetrazole.

17. The method of claim of claim 14 wherein the gas generant formulation contains copper bis-guanyl urea dinitrate as a primary fuel.

18. The method of claim of claim 17 wherein the gas generant formulation contains ammonium nitrate as a primary oxidizer.

19. The method of claim of claim 14 wherein the gas generant formulation contains guanidine nitrate as a primary fuel.

20. The method of claim of claim 19 wherein the gas generant formulation contains basic copper nitrate as a primary oxidizer.

21. The method of claim of claim 14 wherein the gas generant formulation contains a primary oxidizer selected from the group consisting of ammonium nitrate, basic copper nitrate, copper diammine dinitrate and mixtures of ammonium nitrate and copper diammine dinitrate.

22. A gas generant formulation comprising:

a primary fuel component selected from the group consisting of copper bis-guanyl urea dinitrate, guanidine nitrate and mixtures thereof;

a primary oxidizer component selected from the group consisting of ammonium nitrate, basic copper nitrate, copper diammine dinitrate and mixtures of ammonium nitrate and copper diammine dinitrate; and at least one transition metal complex of diammonium bitetrazole effective to enhance the burn rate of the gas generant formulation as compared to the same gas generant formulation without inclusion of the at least one transition metal complex of diammonium bitetrazole.

23. The gas generant formulation of claim 22 wherein the at least one transition metal complex of diammonium bitetrazole includes a transition metal selected from the group consisting of copper, zinc, cobalt, iron, nickel and chromium.

24. The gas generant formulation of claim 22 wherein the primary fuel is guanidine nitrate, the primary oxidizer is basic copper nitrate and the at least one transition metal complex of diammonium bitetrazole is copper diammonium bitetrazole.

25. The gas generant formulation of claim 22 wherein the at least one transition metal complex of diammonium bitetrazole is present in the gas generant formulation in a relative amount of at least 5 wt. %.

* * * * *